US006063717A

United States Patent [19]

Ishiyama et al.

[11] Patent Number: 6,063,717

[45] **Date of Patent: *May 16, 2000**

[54] HYDROENTANGLED NONWOVEN FABRIC AND METHOD OF PRODUCING THE SAME

[75] Inventors: Sadayuki Ishiyama, Setagaya-ku; Jun Yamada, Yokosuka, both of Japan

[73] Assignee: Nippon Petrochemicals Company Ltd., Tokyo, Japan

[ * ] Notice: This patent is subject to a terminal disclaimer.

[21] Appl. No.: 08/849,231

[22] PCT Filed: Oct. 6, 1995

[86] PCT No.: PCT/JP95/02059

§ 371 Date: Jun. 4, 1997

§ 102(e) Date: Jun. 4, 1997

[87] PCT Pub. No.: WO97/13020

PCT Pub. Date: Apr. 10, 1997

[51] Int. Cl.[7] ..... B32B 5/06

[52] U.S. Cl. ..... 442/387; 28/104; 428/105; 428/107; 428/109; 428/113

[58] Field of Search ..... 28/104; 442/387; 428/105, 107, 109, 113

[56] References Cited

U.S. PATENT DOCUMENTS 5,789,328 8/1998 Kurihara et al. ..... 442/387

FOREIGN PATENT DOCUMENTS 54-82481 6/1979 Japan .
54-101981 8/1979 Japan .
59-94659 5/1984 Japan .
61-225361 10/1986 Japan .
1-321960 12/1989 Japan .
3-036948 2/1991 Japan .
4-153351 5/1992 Japan .
4-263660 9/1992 Japan .
4-333652 11/1992 Japan .

*Primary Examiner*—Christopher Raimund
*Attorney, Agent, or Firm*—Scully, Scott, Murphy & Presser

[57] ABSTRACT

A reinforced hydroentangled nonwoven fabric having small thickness and weight, draping characteristics and flexibility, and improved balance of longitudinal and transverse strength, and more particularly a thin, light-weight, reinforced, hydroentangled nonwoven fabric (9) obtained by entangling the fiber of a reinforcing support base (2) or the fiber of a fiber web laminated on the fiber of the support base (2) with the support base (2) and uniting them by ejecting high-pressure thin water jet streams (5a, 5b) against these materials, characterized in that the reinforcing support base (2) comprises a stretched unidirectionally oriented nonwoven fabric obtained by stretching a nonwoven fabric of long fiber, which is produced by spinning a thermoplastic resin, in the direction with the fiber oriented substantially in one direction, or stretched, crossed, laminated, nonwoven fabric obtained by cross-laminating the stretched unidirectionally oriented nonwoven fabric; and a method of producing the same.

8 Claims, 1 Drawing Sheet

HYDROENTANGLED NONWOVEN FABRIC AND METHOD OF PRODUCING THE SAME

FIELD OF THE INVENTION

The present invention relates to an improved hydroentangled nonwoven fabric and a method of producing the same. More particularly, the invention relates to a thin and lightweight hydroentangled nonwoven fabric, which is suitable for use in various purposes because it has good lint-free property (free from fluffiness) and improved drape property (cover and well fit to an outer shape). In addition, the nonwoven fabric of the invention has the smoothness and soft texture like those of ordinary cloths and the strength in longitudinal and transverse directions (warp and weft) are balanced.

The method for producing nonwoven fabrics according to the present invention can be carried out easily and rapidly with retaining the high productivity inherent in the web forming process and hydroentangling process (water jet intertwining process).

Moreover, the present invention relates to a thin, lightweight and reinforced hydroentangled nonwoven fabric, which can be widely used as clothing materials such as interlinings, industrial materials such as filters and wipers and disposable medical products such as surgical gowns, bed-sheets, towels and face masks and to the method of producing the same.

BACKGROUND ART

The prior art hydroentangling method involves the process to subject a card web to high pressure fluid jet streams in order to entangle fibers in web and thereby providing specific entangled structure and suitable mechanical properties to the web.

The nonwoven fabrics produced by this hydroentangling process permits higher mobility of fibers within the fabrics than any other textile fabrics and nonwoven fabrics because the fibers are simply mechanically entangled and not firmly bonded together. Therefore, they have soft and lint-free properties together with improved drape and soft touch properties. On the other hand, they possess disadvantages that they lack mechanical strength and dimensional stability due to the absence of firm fiber bonding.

Furthermore, they also possess another disadvantage that their mechanical strengths in the longitudinal and transverse directions are not balanced because continuous lines are formed in the web in the machine direction by the jet streams of high pressure fluid in the manufacturing process. The imbalance of this kind in mechanical strength may be avoided by applying cross-layer process. However, the crossing-over the web and/or laminating process unfavorably brings about the thickening of resultant nonwoven fabrics and adversely affects the productivity.

In order to solve these problems, various methods have been proposed. Japanese Patent Laid-Open Publication No. 54-82481 discloses a use of nonwoven fabrics made of staple fibers as a reinforcing base material. Japanese Patent Laid-Open Publication No. 54-101981 and No. 61-225361 disclose the use of woven or knitted fabric or nonwoven fabric as a reinforcing material. Japanese Patent Laid-Open Publication No. 59-94659 discloses the use of wood pulp as a reinforcing base material. Japanese Patent Laid-Open Publication No. 01-321960 and No. 04-263660 disclose a process of entangling card web with a reticular base material. Japanese Patent Laid-Open Publication No. 04-333652 and No. 04-153351 disclose a process of entangling card web with spun-bonded nonwoven fabric.

With these prior art techniques, although it is possible to improve the mechanical strength of hydroentangled nonwoven fabrics made, it is not possible to produce, in an economical and simple manner, a thin, lightweight nonwoven fabric having improved balance in strength while retaining its properties such as softness, lint-freeness, drape property and soft touch feeling which are the characteristics of hydroentangled nonwoven fabric.

The incorporation of a cross-layer process in order to improve the balance in mechanical strength of a nonwoven fabric usually brings about the lowering of productivity in the web formation process to a level of ½ to ⅕. In addition, the productivity of subsequent hydroentangling process is also lowered. Even when similar process is done during hydroentangling process or in the subsequent process, similarly, it is not possible to avoid the reduction of productivity. As described above, however, it is apparent that there has not been established any suitable technology to produce a hydroentangled nonwoven fabric having improved properties together with balanced longitudinal and transverse strengths without sacrificing the inherent high productivity of the web formation and hydroentangling processes.

DISCLOSURE OF THE INVENTION

As a result of the intensive studies to solve above-described problems, the finding made by the inventors of this application is that a thin and lightweight hydroentangled nonwoven fabric having improved drape and textile-like characteristics, particularly with excellent lint-freeness and the balance in longitudinal and transverse strengths can be produced. This can be attained through the process that at least one layer of long fiber nonwoven fabric is stretched or rolled so as to arrange its fibers in one direction or a multi-layer material containing the same is then subjected to high pressure water jet streams to entangle the long fibers.

It is, therefore, a first aspect of this invention relates to the provision of a hydroentangled nonwoven fabric which is characterized in the steps that a long fiber nonwoven fabric spun from a thermoplastic resin is unidirectionally stretched to arrange its fibers almost in one direction so as to obtain a stretched unidirectionally arranged nonwoven fabric and at least one of the thus obtained nonwoven fabric or a cross-laid down and/or laminated nonwoven fabric made of the above nonwoven fabrics is subjected to high pressure water jet streams to entangle the fibers of nonwoven fabric.

A second aspect of this invention relates to the provision of a hydroentangled nonwoven fabric which is characterized in that a suitable fiber web is put in layers with the above stretched unidirectionally arranged nonwoven fabric or the stretched cross-laid down and/or laminated nonwoven fabric and the fibers in multi-layer material is entangled by high pressure water jet streams.

A third aspect of the present invention relates to the provision of a hydroentangled nonwoven fabric which is made by using a stretched unidirectionally arranged nonwoven fabric or stretched cross-laid down and/or laminated nonwoven fabric and the card web made of staple fibers such as natural, regenerated or synthetic staple fibers and by entangling the material with high pressure water jet streams.

A fourth aspect of this invention relates to the provision of a hydroentangled nonwoven fabric which is united into one body by entangling, using high pressure water jet streams, the stretched unidirectionally arranged nonwoven fabric or the stretched cross-laid down and/or laminated nonwoven fabric and a long fiber web, in which an unstretched long fiber nonwoven fabric prior to the stretching treatment, a stretched randomly arranged nonwoven fabric, a non-stretched random or unidirectionally arranged nonwoven fabric or a fiber web consisting of natural staples, regenerated staples or synthetic long fibers are used.

A fifth aspect of the present invention relates to the provision of a hydroentangled nonwoven fabric characterized in that the stretching ratio of the stretched unidirectionally arranged nonwoven fabric is 5 to 20, the average fineness is 0.01 to 10 denier and its basis weight is 1 to 80 $g/m^2$.

Furthermore, a sixth aspect of the invention relates to the provision of a method for the preparation of a hydroentangled nonwoven fabric, which method is characterized in that the entangling treatment by applying high pressure water jet streams is done at a water pressure of 10 to 300 $kg/cm^2$ toward the stretched unidirectionally arranged nonwoven fabric, stretched cross-laid down nonwoven fabric or their laminates with a suitable fiber web, and the processing speed is made in the range of 2 to 200 m/min.

BEST MODE FOR CARRYING OUT THE INVENTION

Figure 1:
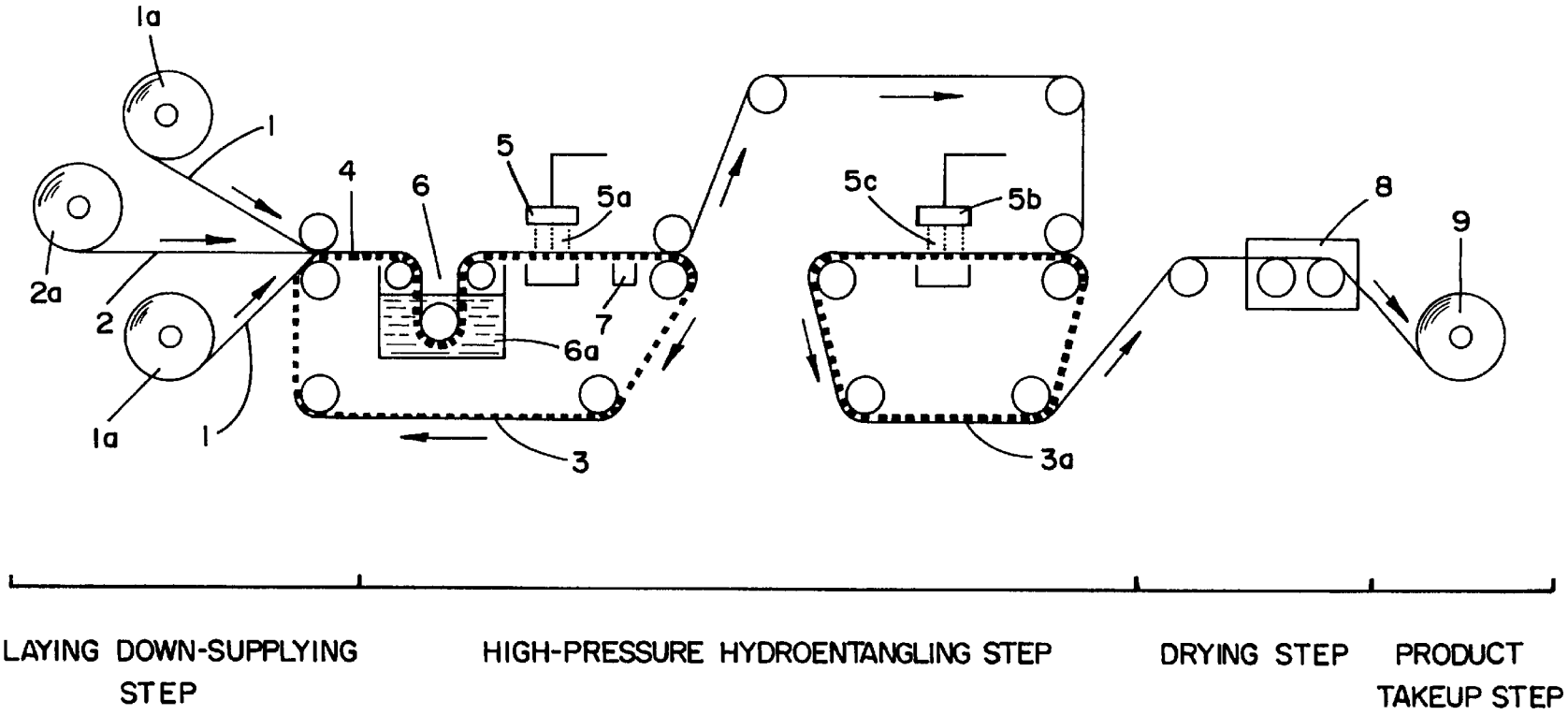
FIG. 1 is a schematic flow sheet illustrating an example of the process of the method of the present invention.

The present invention will be described in more detail in the following.

The above-described long fiber nonwoven fabric can be formed by various known methods. As a characteristics of the nonwoven fabric, it is required that fibers are distributed uniformly not only within the plane but also in the direction of thickness of the nonwoven fabric and that the fibers are arranged regularly in a certain direction. The long fibers used for the formation of a nonwoven fabric may be previously stretched ones, however, they must be still stretchable more than twice in length in subsequent stretching operation.

There have bene proposed various methods for the formation of a long fiber nonwoven fabrics.

(1) A process to provide rotating or vibrating action to filaments spun from thermoplastic resins using hot air and thereby providing fiber arrangement in the longitudinal direction or transverse direction to form a nonwoven fabric, in which most of the fibers are unidirectionally arranged.

(2) A process of spinning of a thermoplastic resin followed by drawing, stretching, opening, collecting and thermal point bonding to form a nonwoven fabric, e.g. spunbonded process.

(3) A process of spinning a thermoplastic resin with high pressure and high temperature air followed by opening the obtained long fibers and arranging them to form a nonwoven fabric, e.g. melt-blown process.

(4) A process of stretching and crimping bundles of long fibers spun from a thermoplastic resin followed by opening and spreading them to form a nonwoven fabric, e.g. tow opening process.

(5) A process of expansion extrusion of a thermoplastic resin followed by foam bursting, laminating and extension to form a nonwoven fabric, e.g. burst fiber process.

As described above, according to the present invention, the high pressure hydroentangling is carried out using a stretched unidirectionally arranged nonwoven fabric comprising at least one layer of nonwoven fabric which is made by unidirectionally stretching the long fibers spun from a thermoplastic resin and arranged in one direction, or a stretched cross-laid down and/or laminated nonwoven fabric formed by overlaying with each other the above-mentioned stretched unidirectionally arranged nonwoven fabrics in such a manner that the axial directions of the arranged fibers of them are crossed.

The term "stretching" as used herein may refer to not only various types of stretching operation but also the rolling operation which is able to achieve similar effect as stretching operation. That is, various conventionally employed stretching methods utilized for the production of films and nonwoven fabrics such as longitudinal stretching, transverse stretching and biaxial stretching may be employed.

As the longitudinal stretching method, short distance roll stretching method is preferable because it enables the stretching without decreasing the width of material. In addition, a stretching method such as rolling, hot air stretching, hot water stretching and steam stretching may be useful.

As a transverse stretching method, although the tenter method used of the biaxial stretching of films may be used, the pulley type transverse stretching method as disclosed in the aforementioned Japanese Patent Publication No. 03-36948 and the transverse stretching method by means of combined grooved rolls (grooved roll method) can be used because of their simple operation.

As a biaxial stretching method, a tenter-type simultaneously biaxial-stretching method which is used for the biaxial stretching of films can be employed. However, it is also possible to accomplish the biaxial stretching by combining the above-described longitudinal stretching and the transverse stretching operation.

The draw (stretching) ratio of the above-described stretched unidirectionally arranged nonwoven fabrics is 5 to 20, preferably 8 to 12. The average fineness of the stretched nonwoven fabric is in the range of 0.01 to 10 denier, preferably 0.03 to 5. The basis weight of single layer or laminated nonwoven fabric is in the range of 1 to 80 $g/m^2$, preferably 5 to 30 $g/m^2$.

According to the present invention, the high pressure hydroentangling can be carried out using any suitable fiber web or nonwoven fabric together with the aforementioned stretched unidirectionally arranged nonwoven fabrics or the stretched cross-laid down and/or laminated nonwoven fabric formed by laminating the stretched unidirectionally arranged nonwoven fabrics. The above fiber web includes card webs and long fiber webs of synthetic fiber, both of which are composed of natural staples, regenerated staples or synthetic staples, a long fiber nonwoven fabric which is the material before the stretching of the stretched unidirectionally arranged nonwoven fabric, a stretched randomly arranged nonwoven fabric, and a non-stretched randomly or unidirectionally arranged nonwoven fabric.

As the thermoplastic resins which can be used as the raw materials of the long fiber nonwoven fabrics in accordance with the present invention, there are exemplified by high density, intermediate density or low density polyethylene, linear low density polyethylene, ultra low density polyethylene, propylene based polymers such as polypropylene and propylene-ethylene copolymers, α-olefin polymers, polyamides, polyesters, polycarbonates, and polyvinyl alcohols. Among them, polypropylene and polyesters are particularly preferably.

These polymers may be used with the addition of antioxidants, UV absorbers, lubricants or the like.

The nonwoven fabric to be used for the high pressure hydroentangling in accordance with the present invention can be any one if it contains at least one layer of the aforementioned stretched unidirectionally arranged nonwoven fabrics which was subjected to unidirectionally stretching and unidirectional orientation in the fiber arrangement. Further, it is possible to combine the stretched unidirectionally arranged nonwoven fabrics with the same type or different type of stretched unidirectionally arranged nonwoven fabrics, or another fiber web or nonwoven fabrics. It is preferably that two or more layers are combined. When the nonwoven fabric comprises two or more layers of stretched or oriented nonwoven fabrics, their directions of stretching or fiber arrangement can be either the same or in crosswise with each other.

The card webs made of natural or regenerated staples and the long fiber webs made of synthetic staples to be used in the present invention cab be formed using any of the following fibers or a mixture of them as raw materials. For example, natural fibers such as cotton, liter and pulp, regenerated cellulose fibers such as rayon and cupra, semi-synthetic cellulose fibers such as acetate fibers, synthetic fibers such as polyethylene, polypropylene, polyester, polyamide, polyacrylonitrile and polyvinyl alcohol fibers, polyurethane or polyester based elastomer fibers, conjugate fibers and composite ultra-fine fibers which are made by dividing or splitting by means of high pressure water jet streams. Furthermore, as a long fiber web, the long fiber nonwoven fabric prior to the stretching for preparing the stretched unidirectionally arranged nonwoven fabric, a stretched randomly arranged nonwoven fabric, a non-stretched randomly or unidirectionally arranged nonwoven fabric are included.

In order to form the fiber web, several processes are employed such as a process to cut wet-spun regenerated fibers or synthetic fibers melt-spun by an ordinary method followed by disentangling the fibers into web by a carding machine, a process to disentangle natural fibers into web by a carding machine or a process to chop and split natural fibers and to form a web by paper-making procedure.

The fineness of the fiber of the card web is preferably in the range of 0.01 to 15 denier, more preferably, 0.03 to 5 denier and its length is preferably in the range of 1 to 100 mm, more preferably, 10 to 60 mm. If the fineness of a single fiber is less than 0.01 denier, nonwoven fabric with inferior lint-freeness will be resulted. If the fiber fineness is over 15 denier, touch feeling of the nonwoven fabric will be harsh. If the fiber length is smaller than 1 mm, the mechanical strength of nonwoven fabric is low due to insufficient fiber entangling. If the fiber length is more than 100 mm, the dispersion of fibers is not good.

The basis weight of the fiber web is preferably in the range of 10 to 150 g/m$^2$, more preferably, 20 to 50 g/m$^2$. If it is less than 10 g/m$^2$, the density of fibers is uneven for the high pressure water jet treating process. When it is over 150 g/m$^2$, the nonwoven fabric is inferior in view of small thickness and lightweight property.

Accordingly, in this invention, as the combination of the above-described card web with the stretched unidirectionally arranged nonwoven fabric or stretch cross-laid down and/or laminated nonwoven fabric (hereinafter referred to as "reinforcing support base"), laminates of two or more layers can be used, which are made by overlaying alternately the card webs (A) with the reinforcing supporting bases (B). The combinations are exemplified by those having layer structure of A/B, A/B/A, B/A/B, and A/B/A/B.

In the following, the method for producing the hydroentangled nonwoven fabric of the present invention will be described.

The producing process of the present invention includes:

(1) Forming processes for a card web and a reinforcing support base.

(2) Laminating and feeding process in which a card web is overlaid with a reinforcing support base and it is fed to the next process.

(3) High pressure hydroentangling process in which water jet treatment is carried out.

(4) Drying process, and (5) Product takeup process.

In the card web forming process, various methods and various patterns of fiber arrangement may be adopted depending on the raw materials used and the uses of final products. As a characteristic features of the card web, uniform fiber distribution within the machine direction (MD) and cross direction (CD) of the card web as well as in the vertical direction of (ZD) is required.

The following examples are methods to provide various patterns of fiber arrangement in the card web.

(1) Card-parallel system by means of a mechanical card web formation method in which fibers are two-dimensionally (MD & ZD) arranged in the longitudinal direction.

(2) Semi-random system wherein a semi-random apparatus provides an intermediate fiber arrangement between two dimensions (MD & CD) and three dimensions (MD, CD & ZD).

(3) Random system wherein fibers are blown off by air blower and fibers are collected on screen meshes.

(4) Spunbond system in which continuous web formation is done by spinning a synthetic resin in wet or dry method, which is followed by stretching, fiber opening, collecting and entangling.

(5) Wet web formation system wherein natural fibers or regenerated fibers are chopped and a web is formed through paper-making process.

In addition, even though the productivity is reduced to some extent, a card-cross layer system can be used as a method to improve the balance of mechanical strengths in three directions by means of mechanical cross web formation method in which fibers are crosswise arranged in oblique directions.

FIG. 1 is a schematic illustration of an example for steps of laying and/or laminating-supplying step and subsequent steps.

In the supplying step, fiber webs 1 and a reinforcing support base 2 are supplied from unwinding rolls 1*a* and 2*a*, respectively, depending on the layer structure of the product to be produced. This step is carried out in off-machine, however, it is also possible to carry out this step in on-machine system, in which the fiber webs and the reinforcing support base are overlaid in a fiber collecting section of fiber web formation processes and the obtained laminate is delivered continuously to the subsequent high pressure hydroentangling process.

In the next high pressure hydroentangling process, a large number of fine water jet streams 5*a* are applied from the rows of small diameter nozzles 5 toward the laminate 4 comprising fiber webs 1 and a reinforcing supporting base 2 supplied on a roll or a screen which serves as a water permeable or impermeable supporting member 3. In order to improve process efficiency, it is preferable to wet the laminate 4 previously by immersing it into water 6*a* in an immersion apparatus 6 before subjecting it to the water jet streams and to remove water from the laminate using a water suction apparatus 7 equipped with a vacuum means or the like after the water jet stream treatment.

Further, it is desirable to apply the high pressure hydroentangling to both sides of the web laminate in order to achieve effective hydroentangling. That is, the laminate 4 delivered from the first supporting member 3 is guided on the second supporting member 3*a* by reversing it and the hydroentangling is again carried out by applying fine water jet streams 5*c* from the rows of small diameter high pressure water jet nozzles 5*c* on the reverse side of the laminate, which laminated has already been subjected to the entangling treatment by water jet streams 5*a*.

In the high pressure hydroentangling process, when the high pressure water jet treatment is carried out on the screen, there is not any particular requirement for the screen to be used, however, it is preferable to select adequate quality of material, mesh size and wire diameter taking in order to facilitate the discharging of process water. The mesh size of the screen is usually ranges from about 20 to 200 mesh.

In the high pressure water jet treatment wherein a water permeable supporting member is used, the process water can be discharged without difficulty. Therefore, the damaging of uniformity in product due to possible web scattering caused by the water jet streams can be avoided. However, the energy efficiency may not be high because the process water once passed through the laminate web still holds considerably amount of energy.

On the other hand, in the high pressure water jet treatment wherein water impermeable supporting member is used, water jet streams once passed through the laminate web collide against the supporting member to generate repulsed water jet streams, thereby providing entangling action again to the laminate. Thus, an improved entangling efficiency will be expected owing to the interaction between jetted stream and repulsed stream of jets. However, it generates a disadvantage of the lowering of entangling stability because the entangling is carried out by jetting high pressure water jet streams to the laminate web which is floating in water.

As a result, it is preferable to perform the high pressure water jet treatment on a water permeable supporting member.

The streams of water jet are ejected from the rows of small diameter nozzles arranged in a pitch of 0.2 mm or more from the vertical direction relative to the direction of laminate movement. The diameter of orifices of the small diameter nozzles is usually less than 1 mm and preferably, in the range of 0.1 to 0.5 mm. The liquid to be jetted is preferably water, but hot water or ultra pure water may be used when hygienic consideration is needed. The pressure of the water jet streams ranges from 10 to 300 kg/cm$^2$, preferably, 20 to 200 kg/cm$^2$. When the pressure of water jet stream is lower than 10 kg/cm$^2$, any sufficient entangling effect may not be expected. Meanwhile, when it is higher than 300 kg/cm$^2$, the increase in the cost for high pressure water jet stream and difficult in handling may be brought about, so that both the cases are undesirable.

The entangling process by jetting high pressure water is usually conducted more than once. It is preferable to carry out the entangling process using a plurality of rows of nozzles and jetting high pressure water with increasing the pressure step by step. That is, the rows of nozzles in the first stage eject relatively low pressure water streams to entangle the surface layer of the laminate web, and subsequent rows of nozzles eject increasingly higher pressure water streams to promote entangling in the intermediate layer to back layer of the laminate web, thereby achieving highly efficient production of a hydroentangled nonwoven fabric without disarray of fibers. Any of a low pressure method (20 to 55 kg/cm$^2$), an intermediate pressure method (55 to 90 kg/cm$^2$), or a high pressure method (90 to 200 kg/cm$^2$) is arbitrary selected depending on the material, shape and basis weight of used webs and the number of treatment.

Although the shape of the high pressure fluid is not limited, columnar streams are preferable in view of the energy efficiency. The cross sectional shape of the columnar stream is defined by the cross sectional shape or internal structure of the small diameter nozzle and it can be selected depending on the material, object and uses of the web.

The processing speed of the hydroentangling step ranges from 2 to 200 m/min. preferably 50 to 150 m/min. If the processing speed is lower than 2 m/min, the productivity is low. On the other hand, if the processing speed is higher than 200 m/min, sufficient entangling effect cannot be attained, which is not desirable.

Finally, the laminate composed of fiber web and reinforcing support base which was subjected to the high pressure hydroentangling is then passed through a drying process, wherein the laminate is dried up using, for example, and oven 8, or a hot air oven, a heated cylinder or the like and it is wound on a roll as a soft, lightweight reinforced hydroentangled nonwoven fabric in the subsequent product takeup step.

The present invention will be further described with reference to the following examples and comparative examples.

EXAMPLE 1, COMPARATIVE EXAMPLE 1

Rayon short fiber material of 2 denier in fineness, 50 mm in length and 20 g/m$^2$ in average basis weight were made into a web ($W_1$) by card-parallel method wherein fibers were oriented into two-dimensional arrangement.

Polyethylene terephthalate (PET) resin (trademark: "MA 2100" made by Unitika Ltd.) was used as a raw material. The resin was spun from a spinneret to form melt-spun filaments and the filaments were arranged longitudinally with applying rotating hot air and collected on a reticular endless belt conveyer, thereby obtaining a long fiber nonwoven fabric composed of longitudinally arranged unstretched filaments of 2 denier in fineness. This nonwoven fabric was longitudinally stretched at a stretching ratio of 10 to make the fineness of fibers 0.2 denier by means of short distance roll stretching and further it was subjected to temporary bonding with polyvinyl alcohol, thereby obtaining a longitudinally stretched unidirectionally arranged nonwoven fabric ($A_1$) having a basis weight of 8 g/m$^2$.

Meanwhile, the same resin was spun likewise to form a long fiber nonwoven fabric of transversely arranged fibers. It was transversely stretched at a stretching ratio of 10 and the fineness of fibers was made 0.2 denier through a pulley type transverse stretching method. Further it was subjected to temporary bonding with polyvinyl alcohol to obtain a transversely stretched unidirectionally arranged long fiber nonwoven fabric ($B_1$) having a basis weight of 8 g/m$^2$.

A stretched cross-laminated nonwoven fabric ($C_1$) having a basis weight of 15 g/m$^2$ was prepared by laying down laminating the nonwoven fabric ($A_1$) with the nonwoven fabric ($B_1$) as the axial directions of the fabrics were crossed and by bonding temporarily using polyvinyl alcohol. Meanwhile, a stretched cross-laminated nonwoven fabric ($D_1$) having a basis weight of 14 g/m$^2$ was prepared by laying down laminating a nonwoven fabric ($A_1$) with a nonwoven fabric ($B_1$) and it was subjected to thermal embossing process. These nonwoven fabrics were used as reinforcing support bases.

Laminates of web layers and a reinforcing support base having layer structures of $W_1/A_1/W_1$, $W_1/B_1/W_1$, $W_1/B_1/B_1/W_1$, $W_1/C_1/W_1$ and $W_1/D_1/W_1$ were prepared. Each laminate was supplied on an endless belt conveyer of water permeable screen composed of a wire netting of 100 mesh and it was then passed under three rows of small diameter nozzles of 0.15 mm in orifice diameter with 1.0 mm pitch, wherein high pressure water jet streams of 70 kg/cm$^2$ were applied in the first row of nozzles, 90 kg/cm$^2$ water jet streams in the second row of nozzles and 110 kg/cm$^2$ water jet streams in the third row of nozzles, respectively. The hydroentangling was carried out once from the upper side of the laminate and once from the reversed side at a processing speed of 100 m/min. After this entangling treatment, the laminate was dried to obtain a thin, lightweight reinforced hydroentangled nonwoven fabric.

As Comparative Examples 1, a card web ($W_1$) made of rayon fiber having the same basis weight was subjected to the hydroentangling treatment with the same conditions.

Properties of the nonwoven fabrics produced in these examples are shown in Table 1.

TABLE 1

| Example | Layer Structure | Basis Weight (g/m$^2$) | Tensile Strength (Lng/Trns) (kg/3 cm width) | Elongation (Lng/Trns) (%) |
|---|---|---|---|---|
| Example 1 | $W_1/A_1/W_1$ | 44 | 4.8/0.3 | 5/7 |
| | $W_1/B_1/W_1$ | 45 | 4.5/4.9 | 18/8 |
| | $W_1/B_1/B_1W_1$ | 51 | 5.1/8.3 | 20/9 |
| | $W_1/C_1/W_1$ | 54 | 8.7/5.8 | 22/5 |
| | $W_1/D_1/W_1$ | 51 | 6.9/5.5 | 10/7 |
| Comp. Exam. 1 | $W_1$ | 50 | 0.4/<0.1 | 8/5 |

Note: (Lng/Trns) = Longitudinal/Transverse

EXAMPLE 2, COMPARATIVE EXAMPLE 2

Short fiber material made of polypropylene (trademark: "Nissaki Polypro J 120" made by Nippon Petrochemicals Co., Ltd.) having fineness of 2 denier, length of 50 mm and basis weight of 20 g/m$^2$, was formed into a web ($W_2$) by two-dimensionally arranging through card-parallel method.

Polypropylene resin having density of 0.9 g/cm$^3$ and melt flow rate of 700 g/10 min as a raw material, was spun into a long fiber nonwoven fabric composed of longitudinally arranged unstretched filaments having fineness of 2 denier through a process in the like manner as in Example 1. Then, the fineness of this nonwoven fabric was reduced to 0.2 denier by longitudinally stretching in the like manner as in Example 1 and it was subjected to temporary adhesion with polyvinyl alcohol to obtain a longitudinally stretched unidirectionally arranged long fiber nonwoven fabric ($A_2$) of 6 g/m$^2$ in basis weight. Furthermore, the fineness of the same raw material as above was reduced to 0.2 denier by transversely stretching in the like manner as in Example 1 and it was subjected to temporary adhesion with polyvinyl alcohol to obtain a transversely arranged long fiber nonwoven fabric ($B_2$) of 6 g/m$^2$ in basis weight.

A stretched cross-laminated nonwoven fabric ($C_2$) having a basis weight of 11 g/m$^2$ was prepared by laying down the nonwoven fabric ($A_2$) with the nonwoven fabric ($B_2$) as the axial directions of the fabrics were crossed and by bonding them temporarily with polyvinyl alcohol. A stretched cross-laminated nonwoven fabric ($D_2$) having a basis weight of 10 g/m$^2$ was prepared by laying down the nonwoven fabric ($A_2$) with the nonwoven fabric ($B_2$) and by bonding them temporarily with polyvinyl alcohol. These nonwoven fabrics were used as reinforcing support bases.

The reinforcing support bases were delivered to the collecting section of a card parallel web forming process and they were laminated into the layer structures of $W_2/A_2/W_2$, $W_2/B_2/W_2$, $W_2/B_2/B_2/W_2$, $W_2/C_2/W_2$ and $W_2/D_2/W_2$. Then they were supplied on an endless belt conveyer composed of water permeable screen of 100 mesh wire net, meanwhile, high pressure water jet streams were applied to the surface of each laminate from the upper side with three rows of nozzles, each of which was composed of a large number of small diameter nozzles, spaced at 1.0 mm pitch, the orifice diameter of 0.15 mm. The pressure of high pressure water jet streams in the first row was 70 kg/cm$^2$, in the second row, 90 kg/cm$^2$ and the third row, 110 kg/cm$^2$, respectively. The hydroentangling treatment was performed once from the upper side of a laminate and then once from the reversed side at a processing speed of 100 m/min. After the entangling treatment, each laminate was dried, thereby obtaining thin, lightweight reinforced hydroentangled nonwoven fabrics.

In Comparative Example 2, only a card web ($W_2$) made of polypropylene fiber having almost the same basis weight as in the above-described Examples were subjected to hydroentangling treatment under the same conditions.

Properties of them are shown in Table 2.

TABLE 2

| Example | Layer Structure | Basis Weight (g/m$^2$) | Tensile Strength (Lng/Trns) (kg/3 cm width) | Elongation (Lng/Trns) (%) |
|---|---|---|---|---|
| Example 2 | $W_2/A_2/W_2$ | 45 | 4.7/0.3 | 5/8 |
| | $W_2/B_2/W_2$ | 44 | 4.7/4.4 | 61/7 |
| | $W_2/B_2/W_2W_2$ | 50 | 5.0/7.7 | 57/6 |
| | $W_2/C_2/W_2$ | 51 | 5.9/5.2 | 11/7 |
| | $W_2/D_2/W_2$ | 50 | 5.7/5.6 | 10/4 |
| Comp. Exam. 2 | $W_2$ | 40 | 0.1/<0.1 | 12/5 |

EXAMPLE 3, COMPARATIVE EXAMPLE 3

The reinforcing support bases ($A_1$) and ($B_1$) which were used in Example 1 were fed to the web receiving section of a stretchable melt-blown nonwoven fabric ($W_3$), made by Kanebo Ltd., trademark: "Esupansione", made of polyurethane fiber. They were laminated together to form layer structures of $W_3/A_1$ and $W_3/B_1$. Then these laminates were fed to an endless belt conveyer of water permeable wire net screen of 100 mesh, then high pressure water jet streams were applied to the laminates from the upper side through three rows of nozzles, each row of which was composed of a large number of small diameter nozzles, with 1.0 mm pitch and with orifice diameter of 0.15 mm. The pressure of high pressure water jet streams in the first row was 70 kg/cm$^2$, the second row, 90 kg/cm$^2$ and the third row, 110 kg/cm$^2$, respectively. The hydroentangling treatment was performed once from the upper surface the laminate and again once from the reversed side at a processing speed of 100 m/min.

After entangling treatment, the laminates were dried to obtain thin, light-weight reinforced hydroentangled nonwoven fabrics.

In Comparative Examples 3, only a melt-blown nonwoven fabric ($W_3$) made of stretchable polyurethane which was used in this Example was subjected to hydroentangling treatment under the same conditions.

Properties of them are shown in table 3.

TABLE 3

| Example | Layer Structure | Basis Weight (g/m$^2$) | Tensile Strength (Lng/Trns) (kg/3 cm width) | Elongation (Lng/Trns) (%) |
|---|---|---|---|---|
| Example 3 | $W_3/A_1$ | 22 | 3.1/0.2 | 6/320 |
| | $W_3/B_1$ | 21 | 0.3/3.4 | 380/7 |
| Comp. Exam. 3 | $W_3$ | 15 | 0.3/0.2 | 380/400 |

EXAMPLE 4, COMPARATIVE EXAMPLE 4

Nylon short fiber material of 2 denier in fineness and 50 mm in length was made into a web ($W_4$) having a basis weight of 25 g/m$^2$ with two-dimensionally arranging by card parallel method.

Using polypropylene resin as a raw material, a longitudinally stretched unidirectionally arranged long fiber nonwoven fabric ($A_2$) and a transversely stretched unidirectionally arranged long fiber nonwoven fabric ($B_2$) was prepared in the like manner as in Example 2. Then, a stretched cross-laminated nonwoven fabric ($C_4$) having a basis weight of 13 g/m$^2$ was prepared by laminating the nonwoven fabric ($A_2$) with the nonwoven fabric ($B_2$) as the axial directions of the fabrics were crossed and by bonding them temporarily with polyvinyl alcohol. Furthermore, a stretched cross-laminated nonwoven fabric ($D_4$) having a basis weight of 12 g/m$^2$ was prepared by laminating the nonwoven fabric ($A_2$) and the nonwoven fabric ($B_2$) as the axial directions of the fabrics were crossed and by applying thermal emboss treatment. These nonwoven fabrics were used as reinforcing support bases.

The webs and reinforcing support bases were laminated to form layer structures of $C_4/W_4/C_4$ and $D_4/W_4/D_4$, and the thus obtained laminates were fed to a water permeable wire net screen of endless belt conveyer of 100 mesh. Then high pressure water jet streams were applied to the laminates from the upper side through three rows of nozzles, each row of which was composed of a large number of small diameter nozzles, with 1.0 mm pitch and with orifice diameter of 0.15 mm. The pressure of high pressure water jet streams in the first row was 70 kg/cm$^2$, the second row, 90 kg/cm$^2$ and the third row, 110 kg/cm$^2$, respectively. The hydroentangling treatment was performed once from the upper surface the laminate and again once from the reversed side at a processing speed of 100 m/min. After the entangling treatment, the laminates were dried to obtain thin, light-weight reinforced hydroentangled nonwoven fabrics.

In Comparative Examples 4, only a melt-blown nonwoven fabric ($W_4$) made of nylon which was used in the above Example was subjected to hydroentangling treatment under the same conditions.

Properties of them are shown in table 3.

TABLE 4

| Example | Layer Structure | Basis Weight (g/m$^2$) | Tensile strength (Lng/Trns) (kg/3 cm width) | Elongation (Lng/Trns) (%) |
|---|---|---|---|---|
| Example 4 | $C_4/W_4/C_4$ | 49 | 6.5/7.0 | 6/8 |
| | $D_4/W_4/D_4$ | 49 | 7.9/8.3 | 8/9 |
| Comp. Exam. 4 | $W_4$ | 50 | 0.8/0.1 | 15/5 |

EXAMPLE 5

Using the same polyethylene terephthalate (PET) resin as the one used in Example 1 as a raw material, a long fiber nonwoven fabric composed of longitudinally arranged unstretched filaments of 2 denier in fineness was obtained by longitudinally arranging filaments spun from a spinneret while providing them rotating action by means of hot air and collecting them on a circulating reticular endless belt conveyer. Then, a longitudinally stretched unidirectionally arranged long fiber nonwoven fabric ($A_5$) with basis weight of 7 g/m$^2$ and fineness of 0.2 denier was obtained by subjecting the long fiber nonwoven fabric to short distance roll stretching at a stretching ratio of 10.

Using the same resin and the same spinning method, a long fiber nonwoven fabric having transversely arranged fibers is formed, and a transversely stretched unidirectionally arranged long fiber nonwoven fabric ($B_5$) with basis weight of 7 g/m$^2$ and fineness of 0.2 denier was obtained by subjecting them to transverse stretching with a stretching ratio of 10 by pulley type transverse stretching method.

A stretched cross-laminated nonwoven fabric ($C_5$) having basis weight of 15 g/m$^2$ was prepared by laminating both the nonwoven fabrics together as the axial directions of the fabrics were crossed and by bonding them temporarily with polyvinyl alcohol. This stretched cross-laminated nonwoven fabric ($C_5$) was delivered on the endless belt conveyer of water permeable screen made of 100 mesh wire net. Then high pressure water jet streams were applied to the surface of the laminate from the upper side through three rows of nozzles, each of which row was composed of a large number of small diameter nozzles, spaced at 1.0 mm pitch with orifice diameter of 0.15 mm, wherein the first row of nozzles gave high pressure water streams at a pressure of 70 kg/cm$^2$, second row nozzles, 90 kg/cm$^2$ and the third row nozzles, 110 kg/cm$^2$, respectively. The hydroentangling treatment was carried out once to the upper side of the laminate and then to the reversed side at a processing speed of 100 m/min. After the entangling treatment, the laminates were dried and a hydroentangled long fiber nonwoven fabrics (a) was obtained. The properties of the nonwoven fabrics are shown in Table 5.

The determination of lint-freeness was carried out according to "5.5.2 Method for Measuring Flocking Strength, 1.5 R Method" of JIS L 1084 (Test Standard for Flock Finished Cloth). In the method, the surface of a test piece was scrubbed and the degree of fluff formed on the surface was observed by naked eyes. In the test, a test piece of 2×6 cm was attached to a scrubbing rod of 1.5 mm in radius of curvature and an abrading cloth (cotton "Shirting No. 3" in JIS L 0803) was scrubbed 100 times with a total load of 400 g at a rate of 30 reciprocations per minute. When flocking was less, it was judged as good, while the flocking was much, not good.

EXAMPLE 6

Polypropylene resin (density: 0.9 g/cm$^3$, melt flow rate: 700 g/10 min) as a raw material was spun in like manner as in Example 5 and a long fiber nonwoven fabric composed of longitudinally arranged unstretched filaments of 2 denier in fineness was obtained. Then, a longitudinally stretched unidirectionally arranged long fiber nonwoven fabric ($A_6$) with basis weight of 5 g/m$^2$ and fineness of 0.2 denier was prepared by subjecting the above nonwoven fabric to short distance roll stretching in the machine direction with a stretching ratio of 10.

The same thermoplastic resin was spun likewise to prepare a transversely arranged long fiber nonwoven fabric was formed and a transversely stretched unidirectionally arranged long fiber nonwoven fabric ($B_6$) with basis weight of 5 g/m$^2$ and fineness of 0.2 denier was prepared by subjecting it to pulley type transverse stretching with a stretching ratio of 10.

A stretched cross-laminated nonwoven fabric ($C_6$) having basis weight of 10 g/m$^2$ was prepared by laminating both the nonwoven fabrics as the axial directions of the fabrics were crossed on the line just after the stretching step of the nonwoven fabric $A_6$.

This stretched cross-laminated nonwoven fabric ($C_6$) was delivered on the endless belt conveyer of water permeable wire net screen of 100 mesh. The high pressure water jet streams were applied to the surface of the laminate from upper side through three rows of nozzles, each of which rows is composed of a large number of small diameter nozzles, spaced at 1.0 mm pitch, with orifice diameter of 0.15 mm, wherein the first row nozzles ejected high pressure water jet streams at a pressure of 70 kg/cm$^2$, the second row nozzles, 90 kg/cm$^2$ and the third row nozzles 110 kg/cm$^2$, respectively. The hydroentangling treatment was performed once on the upper side of the laminate and then on the reversed side at a processing speed of 10 m/min. After the entangling treatment, the laminates were dried to obtain a hydroentangled long fiber nonwoven fabrics (b) was obtained. Properties of them are shown in table 6.

EXAMPLE 7

A nonwoven fabric having a layer structure of $A_5/B_5/B_5/A_5$ with a basis weight of 32 g/m$^2$ was prepared by laminating a longitudinally stretched unidirectionally arranged long fiber nonwoven fabric ($A_5$) and a transversely stretched unidirectionally arranged long fiber nonwoven fabric ($B_5$) as prepared in Example 5 and the laminate was then temporarily bonded with polyvinyl alcohol. This nonwoven fabric was delivered on the endless belt conveyer composed of water permeable screen of 100 mesh wire net. The high pressure water jet streams were then applied to the surface of the laminate from upper side through three rows of nozzles, each of which rows was composed of a large number of small diameter nozzles, spaced at 1.0 mm pitch, with orifice diameter of 0.15 mm, wherein the first row nozzles ejected high pressure water jet streams at a pressure of 70 kg/cm$^2$, the second row nozzles, 90 kg/cm$^2$ and the third row nozzles, 110 kg/cm$^2$, respectively. The hydroentangling treatment was performed once on the upper side of the laminate and then on the reversed side at a processing speed of 10 m/min. After the entangling treatment, the laminates were dried and a hydroentangled long fiber nonwoven fabric (c) was obtained. Its properties are shown in Table 5.

EXAMPLE 8

A long fiber bundles made of PET resin used in Example 5 was subjected to stretching, crimping, fiber opening and spreading to obtain a longitudinally stretched unidirectionally arranged long fiber nonwoven fabric ($A_7$), in which the stretching ratio was 6.5, basis weight, 20 g/m$^2$ and fineness, 0.3 denier. Then, a nonwoven fabric having basis weight of 27 g/m$^2$ was prepared by laminating the above nonwoven fabric with a transversely stretched unidirectionally arranged long fiber nonwoven fabric ($B_5$) used in Example 5 having a basis weight of 5 g/m$^2$ and fineness of 0.2 denier as the axial directions of the fabrics were crossed, and by bonding them temporarily with polyvinyl alcohol.

This nonwoven fabric was delivered on the endless belt conveyer of water permeable screen composed of 100 mesh wire net, then the high pressure water jet streams were applied to the surface of the laminate from upper side through three rows of nozzles, each of which rows comprising a large number of small diameter nozzles, spaced at 1.0 mm pitch, with orifice diameter of 0.15 mm, wherein the first row nozzles ejected high pressure water jet streams at a pressure of 70 kg/cm$^2$, the second row nozzles, 90 kg/cm$^2$ and the third row nozzles, 110 kg/cm$^2$, respectively. The hydroentangling treatment was performed once on the upper side of the laminate and then on the reversed side at a processing speed of 10 m/min. After the entangling treatment, the laminate was dried and a hydroentangled long fiber nonwoven fabric (d) was obtained. The properties of the nonwoven fabric are shown in Table 5.

COMPARATIVE EXAMPLE 5

Short fiber material made of PET of 2 denier in fineness, 50 mm in fiber length and 40 g/m$^2$ in average basis weight was formed into a nonwoven fabric by semi-random card process wherein fibers were arranged into an intermediate state between two-dimensional arrangement and three-dimensional arrangement.

This nonwoven fabric was fed to the endless belt conveyer of water permeable screen composed of 100 mesh wire net. The high pressure water jet streams were applied to the surface of the laminate from upper side through three rows of nozzles, each of which rows comprising a large number of small diameter nozzles, spaced at 1.0 mm pitch, which orifice diameter of 0.15 mm, wherein the first row ejected high pressure water jet streams at a pressure of 70 kg/cm$^2$, the second row nozzles, 90 kg/cm$^2$ and the third row nozzles 110 kg/cm$^2$, respectively. The hydroentangling treatment was performed once on the upper side of the laminate and then on the reversed side at a processing speed of 10 m/min. After the entangling treatment, the laminate was dried and a hydroentangled short fiber nonwoven fabrics (e) having basis weight of 34 g/m$^2$ was obtained. Their properties are shown in Table 5.

TABLE 5

| Example | Layer Structure | Basis Weight (g/m$^2$) | Tensile Strength (Lng/Trns) (kg/3 cm w.) | Elongation (Lng/Trns) (%) | Lint Freeness |
|---|---|---|---|---|---|
| Exam. 5 | (a)$A_5/B_5$ | 14 | 2.5/2.3 | 9/11 | Good |
| Exam. 5 | (b)$A_6/B_6$ | 10 | 1.7/1.8 | 7/8 | Good |
| Exam. 5 | (c)$A_5/B_5/B_5/A_5$ | 28 | 5.8/5.9 | 10/12 | Good |
| Exam. 5 | (d)$A_7/B_5$ | 25 | 2.8/2.4 | 45/7 | Good |
| Comp. Exam. 5 | (d) | 34 | 3.4/1.6 | 45/98 | No Good |

INDUSTRIAL APPLICABILITY

The thin, lightweight reinforced hydroentangled nonwoven fabrics of this invention posses excellent properties in high mechanical strength which has not been achieved with any prior art hydroentangled nonwoven fabrics, despite the nonwoven fabric of the invention are thin and lightweight because they are strengthened by a reinforcing support bases comprising stretched nonwoven fabrics produced by unidirectionally stretching long fiber nonwoven fabrics having unidirectionally arranged fibers or nonwoven fabrics formed by crosswise laying down the stretched nonwoven fabrics.

In addition, it is possible to impart to final products any desired balance in mechanical strengths between longitudinal direction and transverse direction adapted to their uses by selecting adequate reinforcing support base from nonwoven fabrics having high mechanical strength in the longitudinal direction, nonwoven fabrics having high mechanical strength in the transverse direction, or nonwoven fabrics having balanced mechanical strength both in longitudinal and transverse directions.

The thin, lightweight reinforced hydroentangled nonwoven fabrics prepared in accordance with the present invention have improved tensile strength, peel strength, soft touch feeling, drape and uniformity of nonwoven fabric. Moreover, the balance of mechanical strengths between longitudinal direction and transverse direction can be freely designed in compliance with their uses. The method of the present invention is economical without losing the high-speed productivity which is inherent in the web forming process and hydroentangling process. Accordingly, the product according to the present invention can be used widely for apparel materials such as interlining in which the reinforcing function and elongation and direction controlling functions are required, industrial materials such as filters and wiping cloth, disposable medical supplies such as operating gowns, bed sheets, towels and masks.

What is claimed is:

1. A hydroentangled nonwoven fabric produced by the steps which comprise spinning a thermoplastic resin into a long nonwoven fabric and entangling at least one layer of stretched unidirectionally oriented nonwoven fabric or a stretched cross-laid down and/or laminated nonwoven fabric made by crosswise laying down and/or laminating said stretched unidirectionally oriented nonwoven fabric with high pressure water jet streams, said stretched unidirectionally oriented nonwoven fabric being made by unidirectionally stretching said long fiber nonwoven fabric and orienting its fibers almost in one direction.

2. A hydroentangled nonwoven fabric as claimed in claim 1, wherein said hydroentangled nonwoven fabric is produced by laying down or laminating said stretched unidirectionally oriented nonwoven fabric or said stretched cross-laid down and/or laminated nonwoven fabric with an optional fiber web and then entangling with high pressure water jet streams.

3. A hydroentangled nonwoven fabric as claimed in claim 2, wherein said fiber web is any one of a card web made of natural fiber, regenerated fiber or synthetic fiber.

4. A hydroentangled nonwoven fabric as claimed in claim 2, wherein said fiber web is a long fiber nonwoven fabric before the stretching of said stretched unidirectionally oriented nonwoven fabric, a stretched randomly oriented nonwoven fabric, a non-stretched randomly oriented or unidirectionally oriented nonwoven fabric or a fiber web consisting of natural fiber, regenerated fiber of synthetic fiber.

5. A hydroentangled nonwoven fabric as claimed in any of claims 1 to 4, wherein said stretched unidirectionally oriented nonwoven fabric has a stretching ratio of 5 to 20, an average fineness of 0.01 to 10 denier and a basis weight of 1 to 80 g/m$^2$.

6. A method for producing hydroentangled nonwoven fabric comprising the steps of spinning a long fiber nonwoven fabric from a thermoplastic resin, unidirectionally stretching said nonwoven fabric to form a stretched unidirectionally oriented nonwoven fabric having fibers oriented almost in one direction, feeding said stretched unidirectionally oriented nonwoven fabric or a stretched cross-laid down and/or laminated nonwoven fabric made by laying down and/or laminating said stretched unidirectionally oriented nonwoven fabric, and entangling said fed materials by high pressure water jet streams of 10 to 300 kg/cm$^2$ at a processing rate of 2 to 200 m/min.

7. A method for producing hydroentangled nonwoven fabric as claimed in claim 6 wherein said stretched unidirectionally oriented nonwoven fabric or said stretched cross-laid down and/or laminated nonwoven fabric is laid down with an optional fiber web and then high pressure water jet streams of 10 to 300 kg/cm$^2$ at a processing rate of 2 to 200 m/min are applied to entangle said materials together.

8. A method for producing hydroentangled nonwoven fabric as claimed in claim 6 or 7 in which said stretched unidirectionally oriented nonwoven fabric has a stretching ratio of 5 to 20, an average fineness of 0.01 to 10 denier and a basis weight of 1 to 80 g/m$^2$.

* * * * *